US007137174B2

(12) United States Patent
Derbis et al.

(10) Patent No.: US 7,137,174 B2
(45) Date of Patent: Nov. 21, 2006

(54) ACTIVATING MECHANISM FOR CLOSURES WITH FOUR-LINK HINGES

(75) Inventors: Lester Derbis, Auburn Hills, MI (US); Darek Barczynski, Farmington Hills, MI (US); Keith Julien, Canton, MI (US)

(73) Assignee: Gecom Corp, Farmington Hills, MI (US)

( * ) Notice: Subject to any disclaimer, the term of this patent is extended or adjusted under 35 U.S.C. 154(b) by 0 days.

(21) Appl. No.: 10/798,690

(22) Filed: Mar. 11, 2004

(65) Prior Publication Data

US 2004/0205934 A1 Oct. 21, 2004

Related U.S. Application Data

(60) Provisional application No. 60/457,409, filed on Mar. 25, 2003, provisional application No. 60/456,834, filed on Mar. 21, 2003.

(51) Int. Cl.
*E05F 1/08* (2006.01)

(52) U.S. Cl. ..... 16/289; 16/368; 49/248; 49/339

(58) Field of Classification Search ..... 16/366, 16/311, 347, 368–370, 287–289, 265, 277, 16/235, 239; 49/248, 260, 333, 334, 335, 49/339, 340, 341, 349, 386, 358–360, 348, 49/280, 501
See application file for complete search history.

(56) References Cited

U.S. PATENT DOCUMENTS 2,845,299 A * 7/1958 Pickering ..... 296/136.06
3,716,945 A * 2/1973 Cooper et al. ..... 49/139
3,747,271 A * 7/1973 Adamski ..... 49/340
3,851,867 A * 12/1974 Fricko ..... 267/120
4,307,907 A * 12/1981 Barrowman et al. ..... 292/339
4,383,347 A * 5/1983 La Conte ..... 16/360
4,388,744 A * 6/1983 Pantke et al. ..... 16/273
4,510,714 A * 4/1985 Kasper et al. ..... 49/249
5,337,519 A * 8/1994 Bergesio ..... 49/351
5,339,494 A * 8/1994 Esau et al. ..... 16/294
5,557,829 A * 9/1996 Schoen et al. ..... 16/375
5,758,389 A * 6/1998 Wolda ..... 16/308
RE36,267 E * 8/1999 Moore et al. ..... 49/340
6,182,952 B1 * 2/2001 Gutierrez ..... 267/64.11
6,269,521 B1 * 8/2001 Gabel ..... 16/287
6,309,005 B1 * 10/2001 Priest et al. ..... 296/100.06
6,419,294 B1 * 7/2002 Neubrand ..... 296/76
6,520,557 B1 * 2/2003 Benthaus et al. ..... 296/76
6,789,834 B1 * 9/2004 Schlegel ..... 296/76

FOREIGN PATENT DOCUMENTS

DE 3602718 A1 * 8/1987
JP 03119279 A * 5/1991
JP 04-11181 * 1/1992

* cited by examiner

*Primary Examiner*—Robert J. Sandy
*Assistant Examiner*—Andre' L. Jackson
(74) *Attorney, Agent, or Firm*—Barnes & Thornburg LLP

(57) ABSTRACT

An activating mechanism is provided for use with a four-link hinge of the type typically used for closure of a vehicle movable deck, such as a trunk lid or engine compartment hood. A lower link bracket is secured to the vehicle body and an upper link bracket is secured to the movable deck. Pivoting links may be connected between the upper and lower link brackets.

19 Claims, 7 Drawing Sheets

ACTIVATING MECHANISM FOR CLOSURES WITH FOUR-LINK HINGES

PRIORITY CLAIM

This application claims priority to U.S. Provisional Application Ser. No. 60/456,834 filed Mar. 21, 2003 and U.S. Provisional Application Ser. No. 60/457,409 filed Mar. 25, 2003.

BACKGROUND OF THE INVENTION

The present invention relates to mechanisms for closing vehicle trunk lids or engine compartment hoods and particular to mechanisms for closing the type of lids or hoods which are movably supported on what is known as four-link hinges.

Vehicles are being produced today with short trunk lids movably supported on a type of hinge mechanism referred to as a four-link hinge. This hinge allows a trunk lid to move with a wide angle, meeting styling and final user demands. The specific geometry of this hinge makes the trunk lid travel not on an arc about a fixed pivot, but rather about a specific curve established by the links of the hinge. This hinge geometry makes the power activation of the trunk lid difficult, not only because of the curvature of the movement, but because of the high loads on the hinge mechanism. One known way of driving this kind of trunk lid mechanism is to apply the torque directly to one of the crank links of the hinge mechanism. Mercedes Benz has accomplished this on luxury vehicles using a powerful, but expensive hydraulic drive system.

SUMMARY OF THE INVENTION

The present invention comprises one or more of the following features or combinations thereof. An activating mechanism is provided for use with a four-link hinge of the type typically used for closure of a vehicle movable deck, such as a trunk lid or engine compartment hood, the hinge comprising a lower link bracket to be secured to the vehicle body and an upper link bracket to be secured to the movable deck (the trunk lid or hood). Such a typical four-link hinge has pivoting links connected between the upper and lower link brackets. It is the length of these pivoting links and the spacing of the pivot joints which provide the control of the movement of the deck. Typically, a gas spring is used with the four-link hinge in conventional fashion to assist the movement of the hinge.

In the illustrative embodiment, a driving arm having a proximal end and a distal end is provided. This driving arm is pivotable about its proximal end. A driver, such as an electric motor or some electromechanical drive mechanism is provided and configured to drive the driving arm about its proximal end. A track is secured to the movable deck, i.e., to the trunk lid or the engine compartment hood. Then, the distal end of the driving arm is coupled to the track for movement therealong as the driving arm is pivoted about its proximal end. Illustratively, the driving arm may be pivotable about an axis intersecting the lower link bracket of the hinge, and in some cases, the driving arm may be pivotable about a portion of the lower link bracket. The lower link bracket may be configured to provide the pivot axis for the proximal end of the driving arm. Also, illustratively, the track, to which the distal end of the driving arm is coupled, may comprise an extension of the upper link bracket. In other cases, the activator and driving arm and track may be separate from the hinges, for example, located in the central portion or region of the trunk lid.

In some cases, the track may be a channel and a bearing may couple the distal end of the driving arm to the channel, the bearing being movable along the channel. In other cases, the track may be a slot incorporated into the sheet metal of a lid or a separate part fixed to the inner part of the lid. The activator may be an electromechanical driver such as an electric motor with a transmission, having an output shaft which is coupled to the proximal end of the driving arm and defining the axis about which the arm pivots.

The present invention, therefore, is an activating mechanism for use with a four-link hinge or a combination four-link hinge and activating mechanism cooperating together to accomplish the required movement of the trunk lid or engine compartment hood. It is also contemplated that the present invention is a drive actuator comprising an electric motor with a transmission, a drive arm and a track, which actuator is usable with various types of hinge structures. While an electric motor is contemplated as, perhaps, having more cost features attractive to the automotive industry, it will be appreciated that other types of drivers such as hydraulic or pneumatic may be used.

IN THE DRAWINGS

DETAILED DESCRIPTION OF THE DRAWINGS

Figure 1:
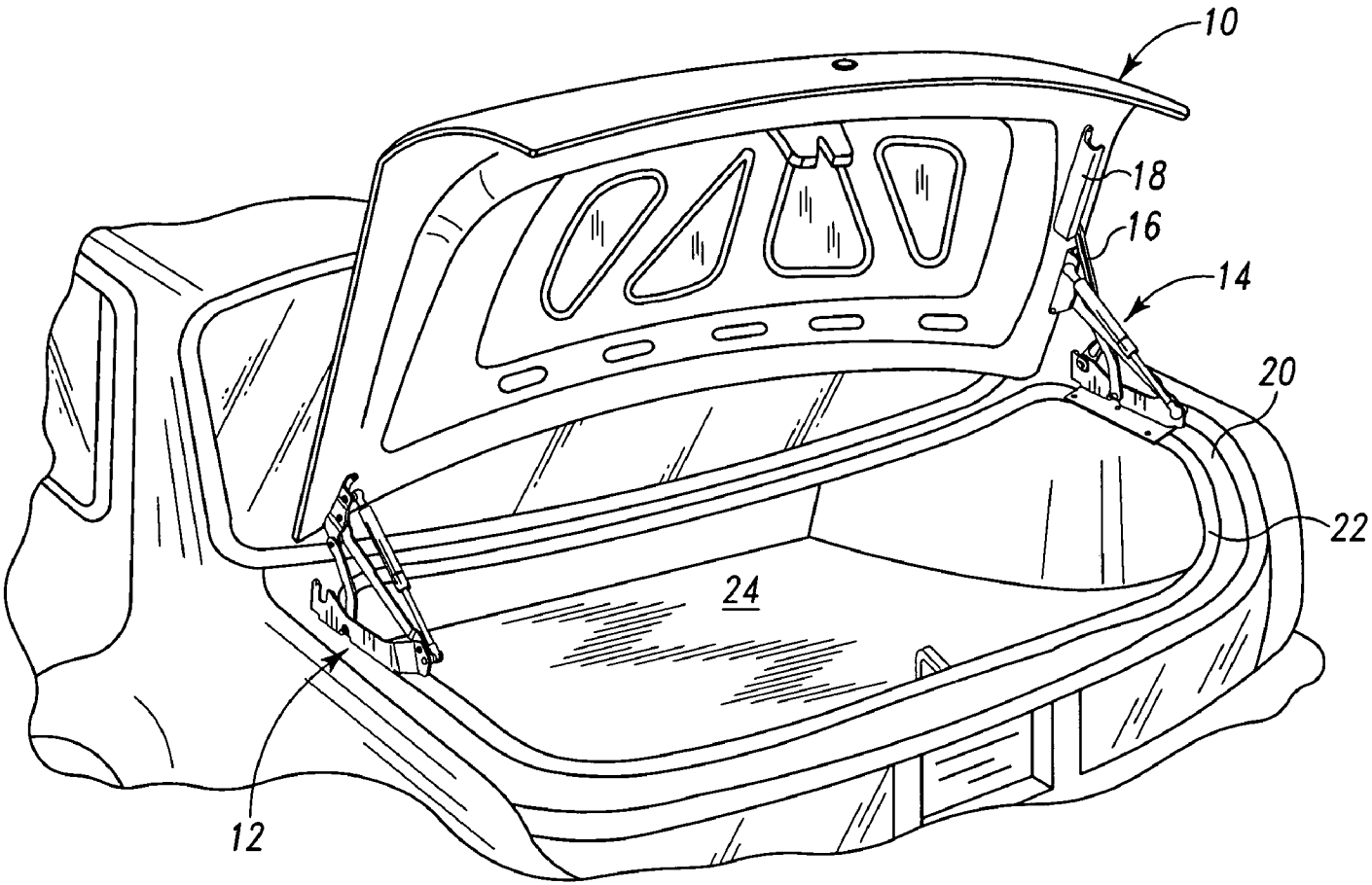
FIG. 1 shows a typical vehicle trunk lid arrangement with four-link hinges at each side of the trunk lid, one of the hinges being modified to accommodate the driving arm and the track.

Referring specifically to the drawings, it will be seen that FIG. 1 shows a vehicle with its trunk lid 10 raised, the trunk lid being supported by four-link hinges 12, 14 at the sides of the trunk. The illustrative four-link hinge to the right has been modified, in accordance with the present invention, to include a driving arm 16 and a track 18. The vehicle may illustratively have a water drain channel such as indicated at 20 with a trunk lid seal as indicated at 22. The space within the trunk is indicated by the reference number 24 in FIG. 1.

It is contemplated that the activating mechanism of the present invention, to be more fully described hereinafter, may illustratively be coupled to one of the four-link hinge assemblies, the assembly 14 as shown in FIG. 1. In other embodiments, the activating mechanism may be separated from the four-link hinges 12, 14 and connected to the trunk lid at some other location such as the central region of the trunk lid as shown in FIG. 2.

Figure 2:
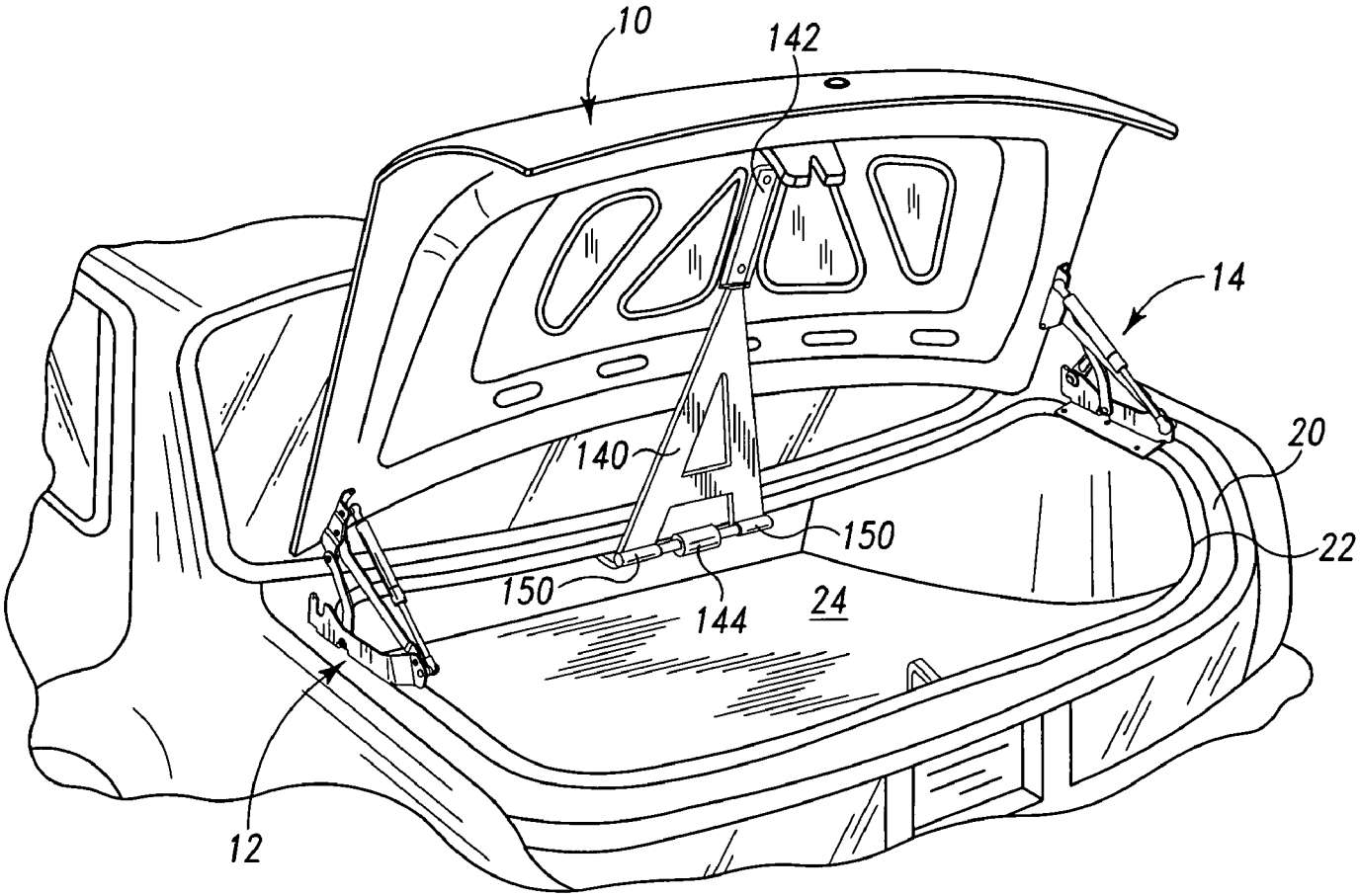
FIG. 2 shows such a vehicle trunk lid arrangement with one embodiment of the activating mechanism coupled to the central region of the trunk lid.

Referring to FIG. 2, it will be seen that the driving mechanism or driving arm is separate from the four-link hinges 12, 14.

Figure 3:
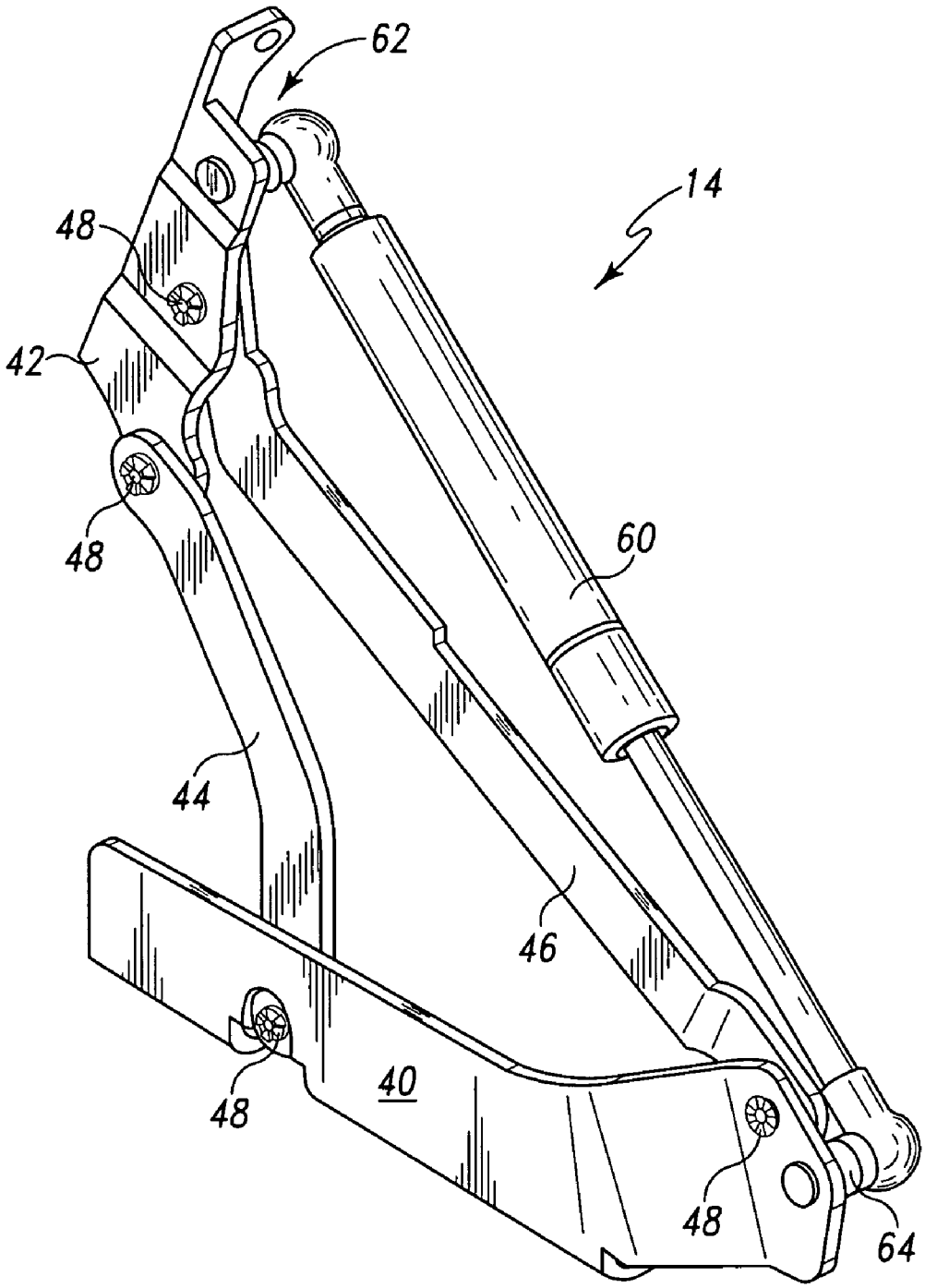
FIG. 3 is a perspective view of a typical four-link hinge with a gas spring.

Referring to FIG. 3, it will be seen that a typical four-link hinge comprises a lower bracket 40 which is configured to be rigidly attached to the vehicle as shown in FIGS. 1 and 2, an upper link bracket 42 which is configured to be attached to the trunk lid 10, and pivot links such as the illustrated forward pivot link 44 and rear pivot link 46 connected between the upper and lower link brackets 40, 42. It will be appreciated that each of these pivot links 44, 46 is pivotally connected at its lower end to the lower link bracket 40 and at its upper end to the upper link bracket 42. The pivot joints for the links 44, 46 are indicated by the reference numeral 48 in FIG. 4. It will be appreciated by those familiar with such typical four-link hinges that the lengths of the pivot links 44, 46 and the spacing of the pivot joins 48 on the lower bracket 40 and upper bracket 42 will determine the curvature of the movement of the bracket 42 relative to the bracket 40 and consequently determine the movement of the trunk 10 relative to the vehicle when the trunk is moved between the closed position and the open position. These typical hinges are equipped with gas springs such as the illustrated spring 60 having its upper end pivotally connected to the bracket 42 as indicated at 62 and its lower end (the distal end of the plunger) pivotally connected to the bracket 40 as indicated at 64.

Figure 4:
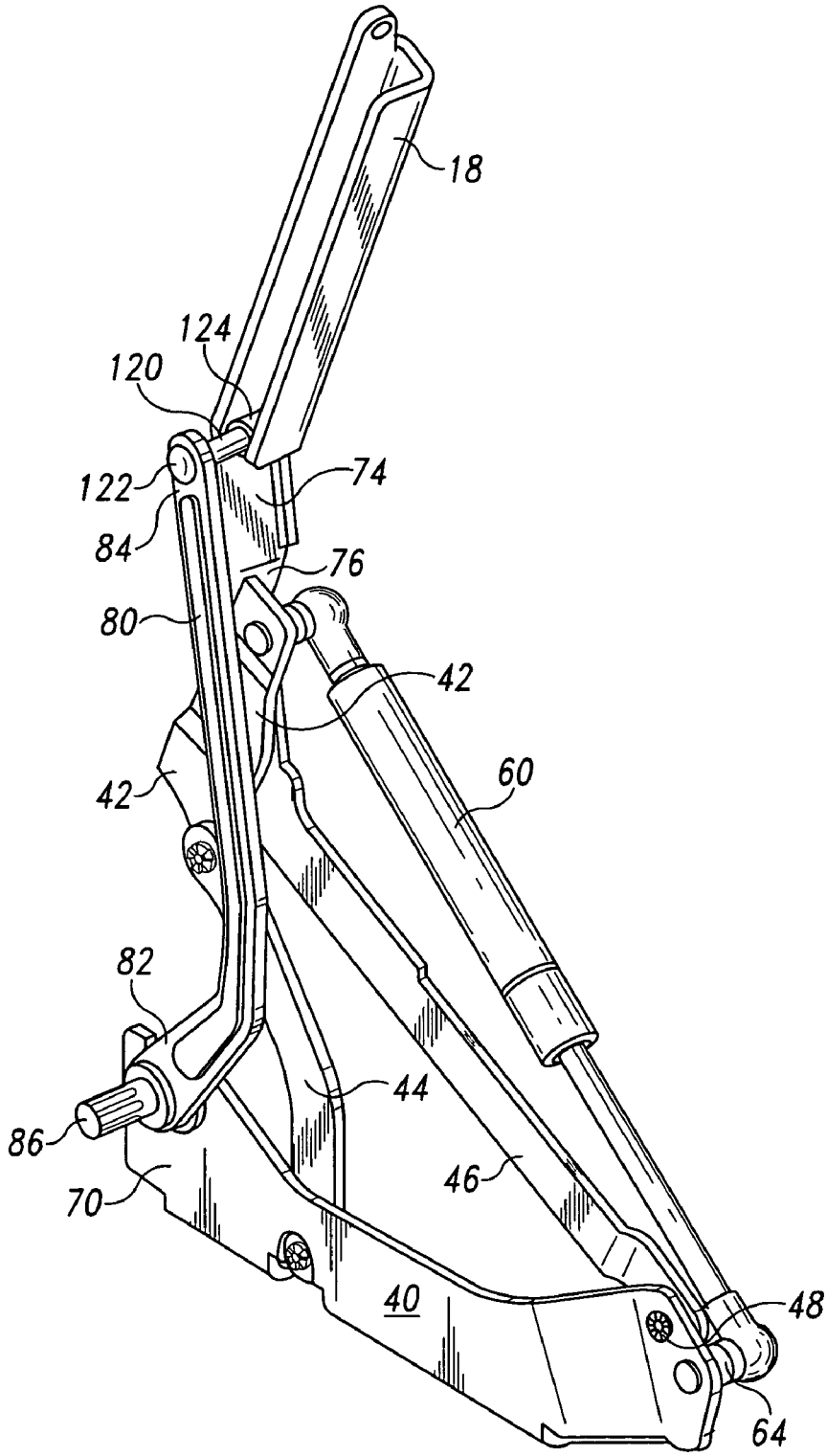
FIG. 4 is a perspective view of a modified four-link hinge shown with the driving arm and track incorporated into the hinge assembly
Figure 5:
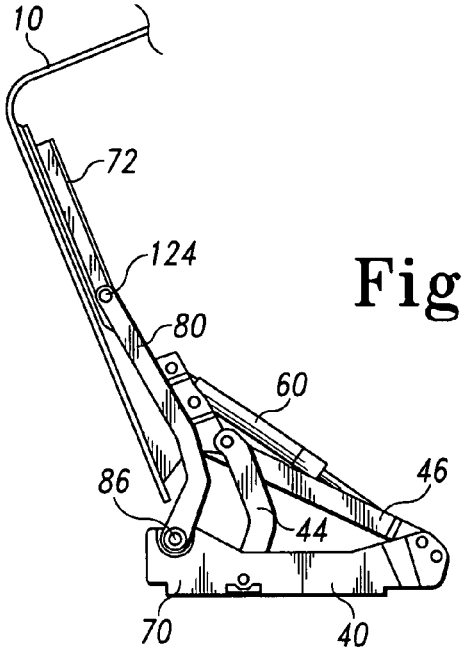
FIG. 5 shows the hinge mechanism of FIG. 4 with a fragment of the trunk lid in a fully open position.
Figure 6:
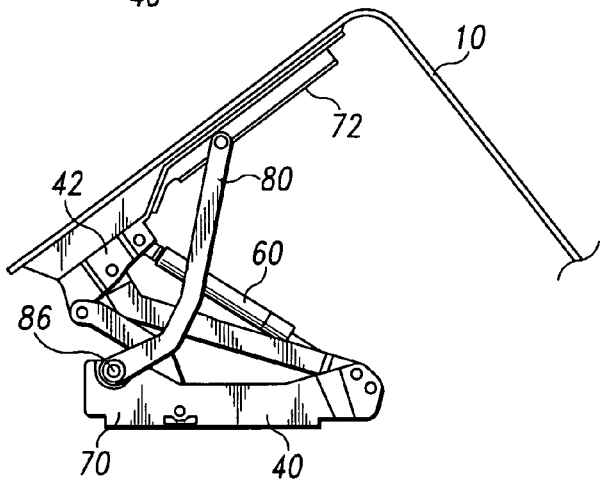
FIG. 6 is a fragmentary view showing the FIG. 4 mechanism in the mid-travel position.
Figure 7:
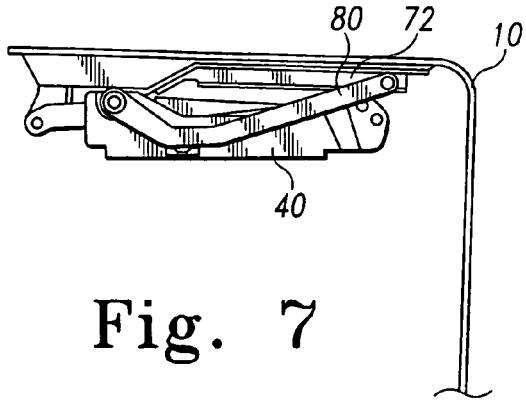
FIG. 7 is a fragmentary view showing the FIG. 4 mechanism in a fully closed position.

FIGS. 5, 6 and 7 illustrate how the hinge assembly shown in FIG. 4 will support a trunk lid 10 for movement from its fully open position to its fully closed position, FIG. 6 showing the mid-travel position. It will be appreciated by those familiar with automotive hinges that variations in travel may take place by changing the lengths of the links 44, 46 and the spacing of the pivot joints 48. The gas spring 60 may be selected to provide appropriate assistance to movement. Such gas springs are well known and an example of such a gas spring may be acquired from Stabilus (Model Number C170) or Meritor.

In FIG. 4, with like reference numbers representing like parts, there is illustrated a four-link hinge modified to accommodate the drive mechanism of the present invention. The modified hinge in FIG. 4 includes a lower link bracket 40 with a forward extension portion 70 (forward with respect to the vehicle) and the upper link bracket 42 has a rigid extension portion providing the track 18. While the channel-track 18 in FIG. 4 is shown as a rigid extension from the upper link bracket 42, connected by flange portion 74 and 76 as illustrated, the track 18 may be separate from the bracket 42.

Figure 9:
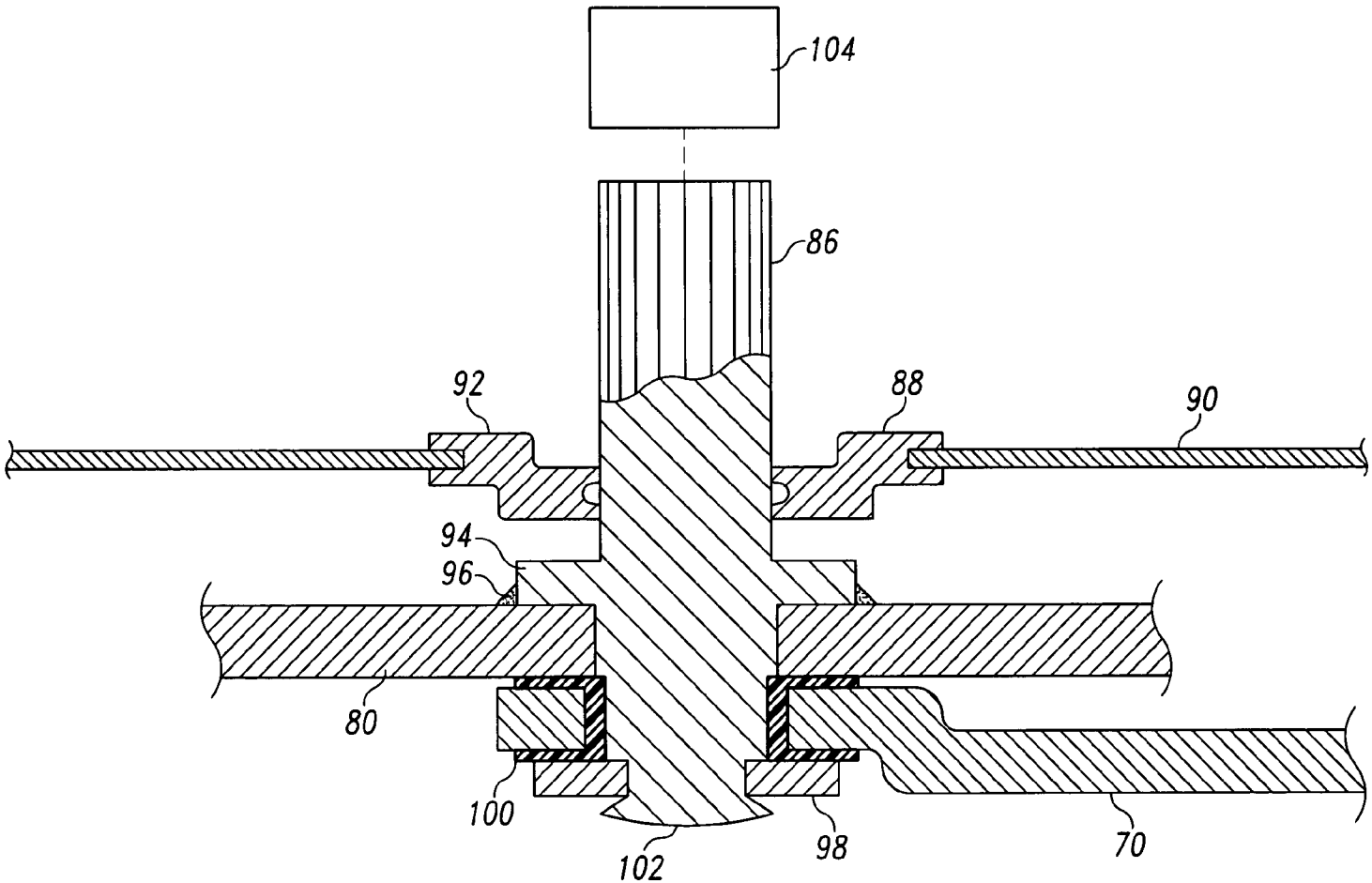
FIG. 9 is a fragmentary sectional view showing how the proximal end of the driving arm may be pivotably connected to the lower link bracket of the hinge.

In the illustrative embodiment of FIG. 4, a driving arm 80 having a proximal end 82 and a distal end 84 is provided, the driving arm 80 being pivotally connected to the extension portion 70 of the lower link bracket 40 for movement in a plane generally parallel to the plane of the movement of the pivot link 44. The proximal end 82 of the arm 80 pivots about an axis defined by a drive shaft indicated at 86. This arrangement of the drive shaft 86 with the lower link bracket 40 extension portion 70 is illustrated in more detail in FIG. 9. The drive shaft 86 may be journalled as indicated at 88 or at least extending through a portal 88 in the vehicle body sheet metal indicated at 90. A sealing grommet 92 may be made to support the drive shaft 86 in the sheet metal 90. Illustratively, as indicated in FIG. 9, the arm 80 may be welded to a flange 94 of the shaft 86 as indicated by the reference numeral 96. Thus, when the drive shaft 86 rotates, the drive arm 80 pivots about the axis of the shaft relative to the lower bracket 40. This coupling of the drive shaft 86 to the lower hinge bracket 40 extension portion 70 may be accomplished as illustrated in FIG. 9 using a washer 98, a bearing bushing 100 journaling the drive shaft 86 with the end of the driving shaft 86 being swaged over the washer 98 as indicated at 102.

In FIG. 9, a driver 104 is indicated diagrammatically and the driver may comprise an electric motor of the type normally used as drivers in the vehicle industry. The driver, for purposes of this disclosure, may comprise an electric motor and the drive shaft or an electric motor in some fashion coupled directly or indirectly to the driving shaft 86. Typically, an electric motor will have a rotary output (rotating shaft) which will be conventionally drivingly connected to the drive shaft 86.

An example of an electric motor which may be used to drive the driving arm 80 about the axis of the shaft 86 may be custom-ordered from Denso or Bosch. Such a motor is illustratively a 12V DC motor with worm gear reduction and may optionally include an electromagnetic clutch built-in.

Figure 8:
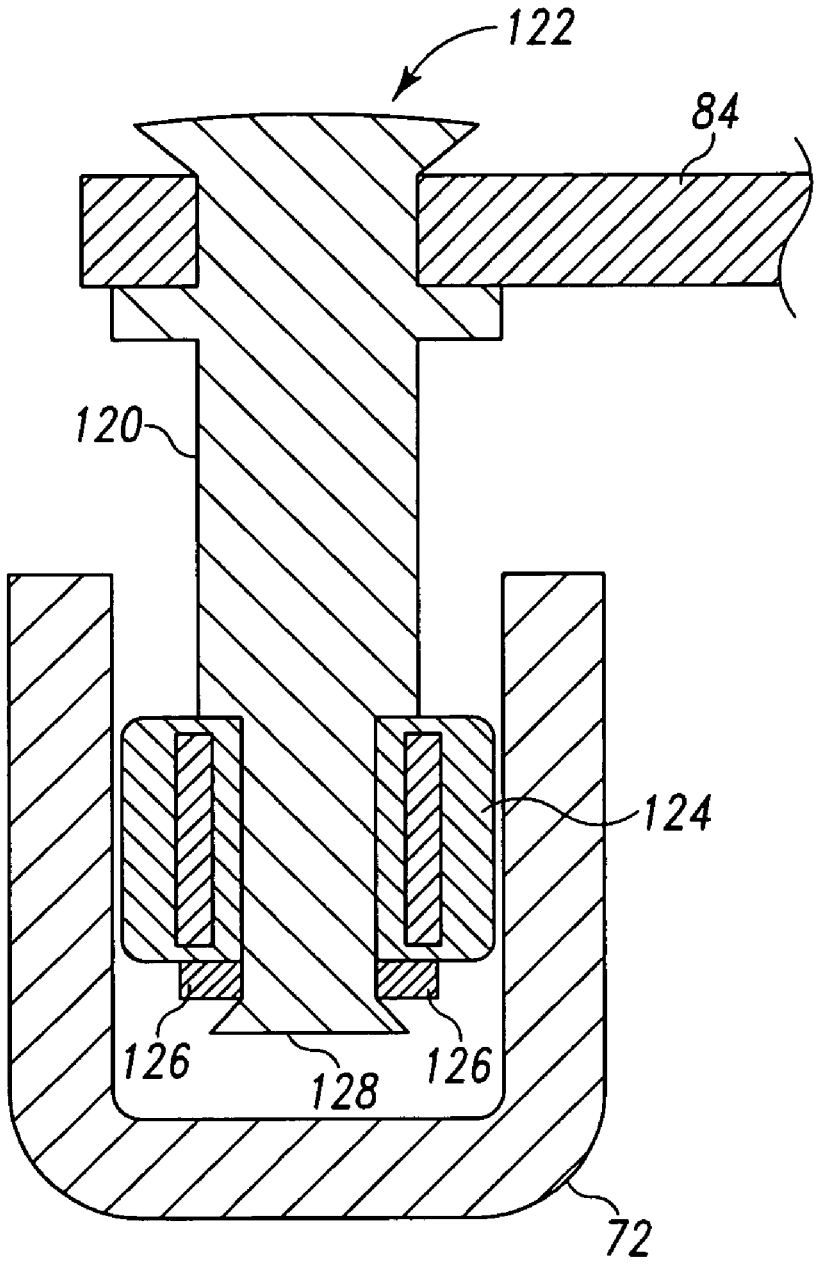
FIG. 8 is a fragmentary sectional view showing a distal portion of the driving arm coupled to the track which illustratively is a channel.

The distal end 84 of the driving arm 80 is illustratively coupled to the track 18 for movement along the track as the arm 80 pivots about the axis of the shaft 86 relative to the lower link bracket 40. This movement of the distal end 84 of the driving arm 80 and the coupling of the distal end to the track 18 raises and lowers the trunk lid 10. In the illustrative embodiment, as shown in FIGS. 4 and 8, the track 18 may be a channel (an U-shaped channel shown in cross-section in FIG. 8) and a roller bearing arrangement may be used to couple the distal end 84 of the arm 80 to the track 18 by a roller pin 120 which is swaged on the driving arm distal end 84 as indicated at 122 and which carries a roller bearing 124 which may be, illustratively, a sealed ball or needle bearing roller. The roller 124 may be secured to the pin 120 by a washer 126 which is swaged as indicated at 128. The channel-track 18 illustrated in FIGS. 4 and 8, which is stationary relative to the trunk lid 10 and the upper bracket 42 may take different forms to provide a track along which the distal end 84 of the drive arm 80 will move. The length of the track 18 will be selected, of course, to accommodate the travel of the distal end 84 of the drive arm 80.

While the FIG. 4 system shows the drive arm 80 closely associated with the hinge assembly, FIG. 2 shows another embodiment where four-link hinges 12, 14 as shown in FIG. 3 are used to support the trunk lid 10 and a drive arm 140 is provided for use with a track 142 located in the central upper portion region of the trunk lid 10. A drive motor 144, which may be an electric motor suitable for use in vehicles, or other driver, may be provided to move the arm 140. In the illustration of FIG. 2, the driving arm of 140 is pivotally mounted as indicated at 150 for movement about a horizontal axis. The distal end of the arm 140 is coupled to the track 142 for movement therealong as the drive arm 140 is pivotally moved relative to the vehicle. The power mechanism, i.e., the motor and drive assembly which moves the driving arm 140, may be mounted below the rear window shelf of the vehicle as shown in FIG. 2.

It will be appreciated, therefore, that the present invention may be enabled by having a drive arm or driving arm which is pivotably movable relative to the vehicle such that its distal end is coupled to a track which is directly or indirectly coupled to the trunk lid so that the distal end will move along the track as the arm is pivoted. Various types of drive motors or drive actuators may be provided for powered movement of the driving arm relative to the vehicle. The driving arm may be closely associated with one of the four-link hinges, or with both of them, or separate from the hinge as shown in FIG. 2. While the FIG. 4 arm 80 and the FIG. 2 arm 140 have the illustrative shapes shown in the drawings, it will be appreciated that such arms may take a variety of shapes. While the illustrative tracks are rectilinear, it will be appreciated that in some cases the tracks may be curved depending on the application.

The invention claimed is:

1. For use with a four-link hinge of the type typically used for closure of a vehicle movable deck such as a trunk lid or engine compartment hood, the hinge comprising a lower link bracket to be secured to the vehicle body, an upper link bracket to be secured to the movable deck, and pivoting links connected between the upper and lower brackets, wherein each pivoting link has a first end pivotally connected to the upper link bracket and a second end pivotally connected to the lower link bracket, an activating mechanism comprising:

(a) a driving arm having a proximal end and a distal end, the driving arm being pivotal about its proximal end, (b) a driver having an output shaft that moves about its axis, the output shaft of the driver being coupled to the proximal end of the driving arm, (c) a track to be carried by the movable deck, and (d) the distal end of the driving arm being coupled to the track, the distal end of the driving arm moves along the track as the driving arm is pivoted about its proximal end.

2. The invention of claim 1 wherein the track comprises an extension of the upper link bracket.

3. The invention of claim 1 wherein the track is a channel and a bearing couples the distal end of the driving arm to the channel, the bearing being movable along the channel.

4. The invention of claim 1 wherein the driver is an electro-mechanical driver having an output shaft coupled to the proximal end of the driving arm and defining the axis about which the arm pivots.

5. The invention of claim 1 wherein the driving arm is pivotal about an axis intersecting the lower bracket.

6. The invention of claim 5 wherein the lower link bracket provides the pivot axis for the proximal end of the driving arm.

7. The invention of claim 1 wherein the track is configured to be placed in the central region of the deck to extend in the longitudinal direction of the vehicle.

8. The invention of claim 7 wherein the driving arm proximal end is pivotally connectable to the central region of the vehicle and is generally in alignment with the track.

9. A vehicle trunk lid or engine compartment hood closure mechanism comprising:

(a) a four-link hinge comprising a lower link bracket to be secured to the vehicle body, an upper link bracket to be secured to the vehicle lid or hood, and a pair of pivoting links connected between the upper and lower link brackets, each pivoting link having a first end pivotally connected to the upper link bracket and a second end pivotally connected to the lower link bracket, (b) a driving arm having a proximal end and a distal end, the driving arm being pivotal about its proximal end, (c) a driver having an output shaft that moves about its axis, the output shaft of the driver being coupled to the proximal end of the driving arm, (d) a track to be secured to the lid or hood, and (e) the distal end of the driving arm being coupled to the track, the distal end of the driving arm moves along the track as the driving arm is pivoted about its proximal end.

10. The invention of claim 9 wherein the track comprises an extension of the upper link bracket.

11. The invention of claim 9 wherein the track is a channel and a bearing couples the distal end of the driving arm to the channel, the bearing being movable along the channel.

12. The invention of claim 9 wherein the driver is an electro-mechanical driver having an output shaft coupled to the proximal end of the driving arm and defining the axis about which the arm pivots.

13. The invention of claim 9 wherein the driving arm is pivotal about an axis intersecting the lower bracket.

14. The invention of claim 13 wherein the lower link bracket provides the pivot axis for the proximal end of the driving arm.

15. The invention of claim 9 wherein the track is configured to be placed in the central region of the lid to extend in the longitudinal direction of the vehicle.

16. The invention of claim 15 wherein the driving arm proximal end is pivotally connectable to the central region of the vehicle and is generally in alignment with the track.

17. A closure mechanism for opening and closing a vehicle trunk lid comprising:

(a) a four-link hinge comprising a lower link bracket to be secured to the vehicle body, an upper link bracket to be secured to the vehicle movable deck and at least one pivoting link having a first end pivotally connected to the upper link bracket and a second end pivotally connected to the lower link bracket, (b) a driving arm having a proximal end and a distal end, the driving arm being pivotal about its proximal end, (c) a driver having an output shaft that moves about its axis, the output shaft of the driver being coupled to the proximal end of the driving arm, (d) a track to be secured to the vehicle movable deck and extending generally parallel to the longitudinal axis of the vehicle, and (e) the distal end of the driving arm being coupled to the track, the distal end of the driving arm moves along the track as the driving arm is pivoted about its proximal end.

18. The invention of claim 17 wherein the track is a channel and a bearing couples the distal end of the driving arm to the channel, the bearing being movable along the channel.

19. The invention of claim 17 wherein the driver is an electro-mechanical driver having an output shaft coupled to the proximal end of the driving arm and defining the axis about which the arm pivots.

* * * * *